US006607365B1

(12) United States Patent
Kabasawa et al.

(10) Patent No.: US 6,607,365 B1
(45) Date of Patent: Aug. 19, 2003

(54) VACUUM PUMP AND VACUUM APPARATUS

(75) Inventors: Takashi Kabasawa, Chiba (JP); Takashi Okada, Chiba (JP); Manabu Nonaka, Chiba (JP)

(73) Assignee: Seiko Seki Kabushiki Kaisha (JP)

( * ) Notice: Subject to any disclaimer, the term of this patent is extended or adjusted under 35 U.S.C. 154(b) by 0 days.

(21) Appl. No.: 09/383,652

(22) Filed: Aug. 26, 1999

(51) Int. Cl.[7] ..... F04B 49/00
(52) U.S. Cl. ..... 417/295; 417/423.4
(58) Field of Search ..... 251/229; 415/143, 415/55.1, 90; 417/201, 63, 295, 281, 203, 423.4, 410.4; 418/201.2

(56) References Cited

U.S. PATENT DOCUMENTS

| | | | | | |
|---|---|---|---|---|---|
| 3,857,545 | A | * | 12/1974 | Santi | 251/229 |
| 3,947,193 | A | * | 3/1976 | Maurice | 415/143 |
| 4,090,815 | A | * | 5/1978 | Nakamura | 417/203 |
| 4,797,068 | A | * | 1/1989 | Hayakawa et al. | 417/201 |
| 4,822,251 | A | * | 4/1989 | Amrath et al. | 417/63 |
| 5,221,179 | A | * | 6/1993 | Ikegami et al. | 415/55.1 |
| 5,236,313 | A | * | 8/1993 | Kim | 417/281 |
| 5,261,802 | A | * | 11/1993 | Yanagisawa | 418/201.2 |
| 5,445,502 | A | * | 8/1995 | Iton et al. | 417/203 |
| 5,451,147 | A | * | 9/1995 | Sakagami et al. | 417/423.4 |
| 5,848,873 | A | * | 12/1998 | Schofield | 415/90 |
| 5,951,266 | A | * | 9/1999 | Maruyama et al. | 417/410.4 |
| 6,030,189 | A | * | 2/2000 | Bohm | 417/423.4 |

FOREIGN PATENT DOCUMENTS

| | | |
|---|---|---|
| JP | 1118190 | 8/1989 |
| JP | 3107599 | 5/1991 |
| JP | 8-68389 | 3/1996 |

* cited by examiner

*Primary Examiner*—Teresa Walberg
*Assistant Examiner*—Leonid Fastorsky
(74) *Attorney, Agent, or Firm*—Adams & Wilks

(57) ABSTRACT

A vacuum pump capable of controlling a gas sucking performance is provided. A conductance variable mechanism (50) is arranged at an inlet port (16) formed inside a flange (11). The conductance variable mechanism (50) allows the area of a cross-section of the inlet port to be increased or decreased relative to the direction where gas is fed, so that an amount of gas to be sucked from the inlet port (16) can be controlled.

11 Claims, 15 Drawing Sheets

PRIOR ART

PRIOR ART

VACUUM PUMP AND VACUUM APPARATUS

BACKGROUND OF THE INVENTION

1. Field of the Invention

The present invention relates to a vacuum pump and a vacuum apparatus, and more specifically to a vacuum pump and a vacuum apparatus capable of controlling a sucking performance for gas within a vacuum container.

2. Description of the Related Art

When a semiconductor or a liquid crystal is manufactured through dry etching, CVD and the like, a vacuum apparatus is employed in which a process gas is introduced into a chamber, and the introduced process gas is sucked and discharged by means of a vacuum pump.

Now, FIG. 15 shows a turbomolecular pump taken as an example of vacuum pumps conventionally used for such vacuum apparatuses.

As shown in FIG. 15, a vacuum pump (turbomolecular pump) is so arranged as follows. Stator blades and rotor blades are axially arranged in a multi-stage manner in a stator section and a rotor section, respectively, which constitute a turbine. The rotor section is rotated at a high speed by a motor, thereby being capable of conducting an exhaustion (vacuum) process from an inlet port shown in an upper portion of the figure to an outlet port shown in a lower left portion of the figure.

FIG. 16 is an explanatory diagram showing an outline of the conventional vacuum apparatus having a chamber equipped with such a vacuum pump.

As shown in FIG. 16, the conventional vacuum apparatus is provided with an outlet port on a bottom surface (or a side surface) of a chamber (container) 90. A process gas received in the chamber 90 may be then sucked and discharged externally of the chamber 90 by means of a vacuum pump 95 through this outlet port. A conductance variable valve 96 having an elongated value is intermediately arranged between the outlet port and the vacuum pump 95. This conductance variable valve 96 adjusts an amount of the process gas to be sucked and discharged into the vacuum pump 95, to thereby control a pressure in the chamber 90 to be set within a certain range.

It should be noted that although not shown in this figure, a stage on which a sample and the like are placed is provided in the chamber (container) 90, while a driving mechanism for rotating the stage and the like is arranged externally of the chamber 90 below the stage.

However, in such a conventional vacuum apparatus, the conductance variable valve 96 is placed to maintain the atmospheric pressure in the chamber 90 within a certain range. This conductance variable valve 96 must adjust an amount of gasses to be sucked by the vacuum pump 95.

The conductance variable valve 96 is intermediately arranged between the chamber 90 and the vacuum pump 95, with the result that a vacuum apparatus as a whole becomes larger in size, and requires a large space for installing the apparatus. Besides, there arise such problems in that a manufacturing cost is increased and a time-consuming assembly is required.

In addition, the intervention of the valve between the chamber 90 and the vacuum pump 95 causes a conductance to be deteriorated, which may also affect the exhaustion performance of the vacuum pump 95. Such problems are also concerned.

SUMMARY OF THE INVENTION

In view of the above, the present invention has been made, and therefore has a primary object of the present invention to provide a vacuum pump capable of controlling a gas sucking performance.

Further, a secondary object of the present invention is to provide a vacuum apparatus requiring a small space for installing the apparatus with less manufacturing cost and less time-consuming assembly.

In order to attain the above-mentioned primary object of the present invention, there is provided a vacuum pump comprising: an inlet port for sucking gas; a gas feeding portion for feeding gas sucked from the inlet port; an outlet port for discharging the gas to an outside fed by the gas feeding portion; a passage area increasing/decreasing mechanism for increasing/decreasing an area of a gas passage, provided at least one place from the inlet port to the outlet port including the gas feeding portion; and a control means for controlling the passage area increasing/decreasing mechanism to increase/decrease the area of the gas passage.

According to the vacuum pump of the present invention, the control of a passage area increasing/decreasing mechanism allows a pressure at an inlet port to be varied, so that a gas sucking performance of the vacuum pump can be controlled.

In order to attain the above-mentioned secondary object of the present invention, there is provided a vacuum apparatus comprising the vacuum pump as described above and a container from which gas received therein is sucked and discharged by the vacuum pump.

In this connection, preferably, the vacuum apparatus further comprises a pressure sensor for outputting a signal corresponding to a pressure within the container, wherein the control means determines an amount to be controlled responding to the output from the pressure sensor.

DESCRIPTION OF THE PREFERRED EMBODIMENTS

Preferred embodiments of the present invention will now be described with reference to the accompanying drawings.

Figure 1:
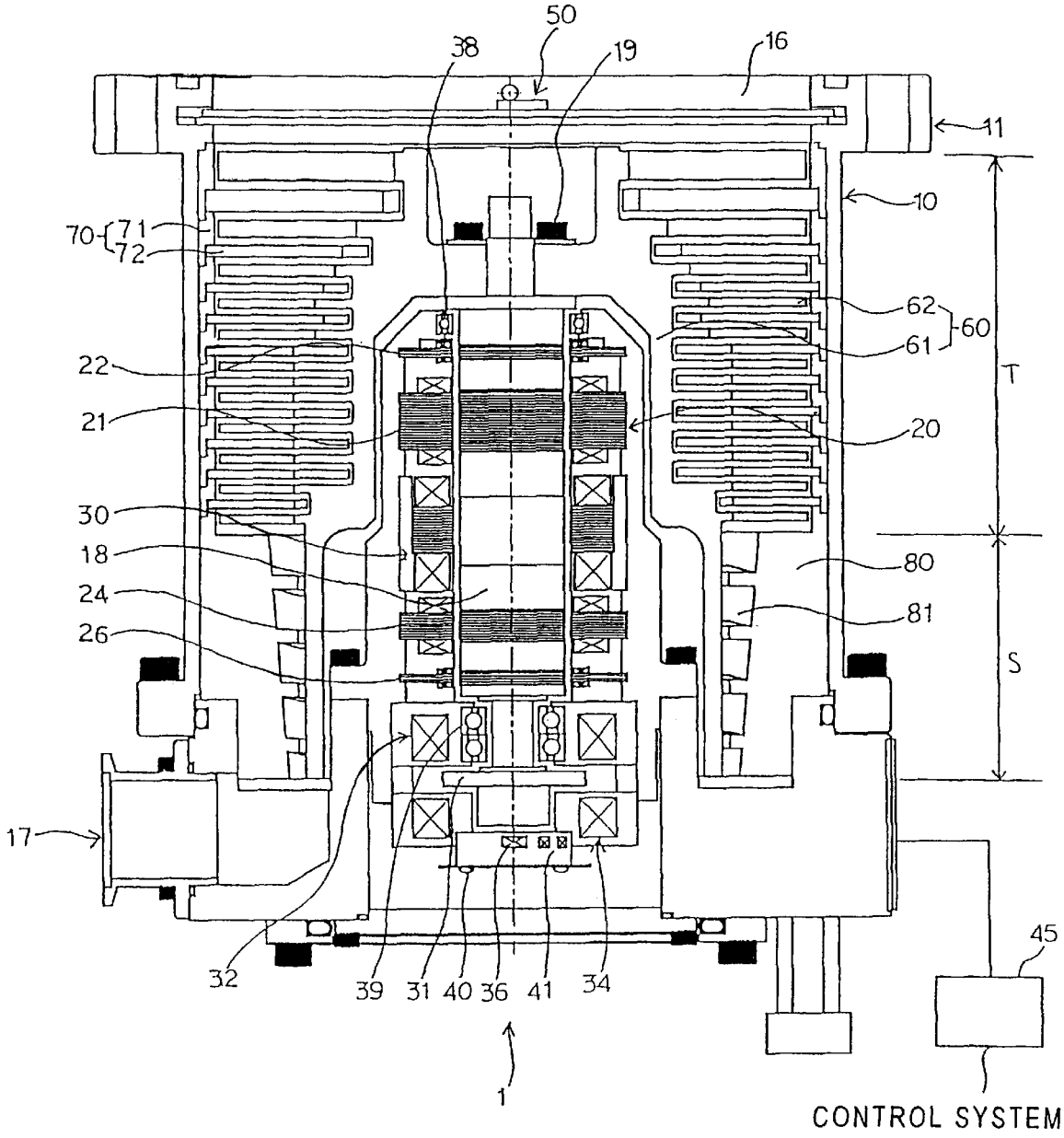
FIG. 1 is a view showing a cross-section of the entire structure of a vacuum pump according to an embodiment of the present invention.

FIG. 1 is a view showing a cross-section of the entire structure of a vacuum pump according to an embodiment of the present invention.

A vacuum pump 1 is arranged in, for example, a semiconductor manufacturing equipment or the like so as to discharge a process gas from a chamber and the like. The vacuum pump 1 comprises a turbomolecular pump section T and a thread groove pump section S. The turbomolecular pump section T is adapted to feed a process gas from a chamber and the like toward the downstream side by means of stator blades 72 and rotor blades 62. The thread groove pump section S is adapted to further deliver the process gas fed from the turbomolecular pump section T by means of a thread groove pump for discharge.

As shown in FIG. 1, the vacuum pump 1 comprises an outer casing 10 having a substantially tubular shape, a rotor shaft 18 having a substantially cylindrical shape, a rotor 60, and a stator 70. The rotor shaft 18 is disposed at the center of the outer casing 10, and the rotor 60 is fixedly arranged onto the rotor shaft 18 and rotated in association with the rotor shaft 18.

The outer casing 10 is formed with a flange 11 on the top end thereof which extends outwardly in a radial direction. The flange 11 is secured to the semiconductor manufacturing equipment or the like with bolts etc. so as to communicatingly couple an inlet port 16 formed inside the flange 11 with an outlet port of a container such as a chamber. The inner portion of the container and the inner portion of the outer casing 10 can be then communicated with each other.

Figure 2:
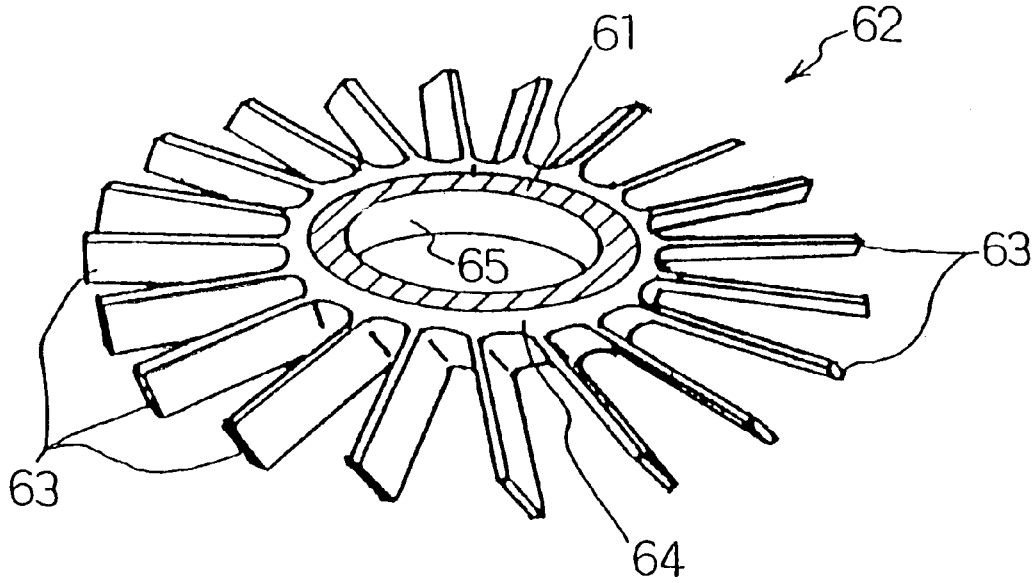
FIG. 2 is a perspective cross-sectional view in which a rotor of the vacuum pump shown in FIG. 1, is cut along the upper and lower surfaces of a rotor blade.

FIG. 2 is a perspective cross-sectional view in which the rotor 60 is cut along the upper and lower surfaces of the rotor blade 62.

The rotor 60 comprises a rotor body 61 having a substantially inverted U-shape in cross-section, which is arranged around the circumference of the rotor shaft 18. The rotor body 61 is attached to the top of the rotor shaft 18 with bolts 19. In the turbomolecular pump section T, the rotor body 61 is formed with a rotor annular portion 64 in a multistage manner around the outer circumference thereof. As apparent from FIG. 2, the rotor blade 62 is annularly mounted to the rotor annular portion 64. The rotor blade 62 at each stage is provided with a plurality of rotor blades 63 each having an outward open end.

In the turbomolecular pump section T, the stator 70 comprises spacers 71, stator blades 72 arranged between the rotor blades 62 at the respective stages while the outer circumferences thereof are held between the spacers 71 and 71. In the thread groove pump section S, there is provided a thread groove spacer 80 adjoining to the spacers 71.

The spacers 71 have a tubular shape with stepped portions and are stacked in layers inside the outer casing 10. The length of the stepped portions in the axial direction positioned inside the spacers 71 corresponds to the intervals between the respective stepped portions at the rotor blades 62.

Figure 3:
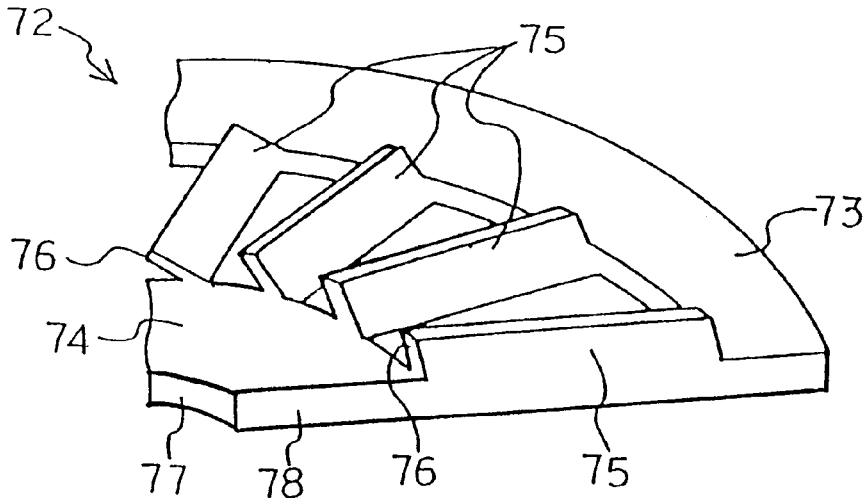
FIG. 3 is a perspective view showing a part of a stator blade in the vacuum pump shown in FIG. 1.

FIG. 3 is a perspective view showing a part of a stator blade.

The stator blade 72 is made up of: an outer annular portion 73 having a part of which is sandwiched by the spacers 71 in the circumferential direction; an inner annular portion 74; and a plurality of blades 75 each having both ends radially supported with inclined at a certain angle by the outer annular portion 73 and the inner annular portion 74. The inner diameter of the inner annular portion 74 is larger than the outer diameter of the rotor body 61 so that the inner peripheral surface 77 of the inner annular portion 74 may not be brought into contact with the outer peripheral surface 65 of the rotor body 61.

The stator blade 72 is circumferentially divided into two to be arranged between the rotor blades 62 at the respective stages. The stator blade 72 is formed into a shape shown in FIG. 3 in such a manner as follows. A half-annular outline portion and portions corresponding to the blades 75 are cut from, for example, a thin plate made of a stainless steel or aluminum, which is divided into two in this way, by means of etching etc. The portions corresponding to the blades 75 are then bent to have a predetermined angle by press-machining.

Each s tator blade 72 at the respective stages can be held between the rotor blades 62, since the outer annular portion 73 is circumferentially sandwiched by the stepped portions between the spacers 71 and 71.

Back to FIG. 1, the thre ad groove spacer 80 is arranged inside the outer casing 10, and coupled with the spacers 71, while being provided beneath the spacers 71 and the stator blades 72. The thread groove'spacer 80 is thickened so that the inner diameter wall extends to the position close to the outer peripheral surface of the rotor body 61. A plurality of thread grooves 81 each having a spiral structure, are formed in the inner diameter wall. Each thread groove 81 is communicated with the space between the stator blade 72 and the rotor blade 62. Gas fed between the stator blade 72 and the rotor blade 62 is i ntroduced into the thread grooves 81, and further fed into the grooves 81 as the rotor body 61 rotates.

While the thread grooves 81 are formed at the side of the stator 70 according to the present embodiment, the thread grooves 81 may be formed in the outer diameter wall of the rotor body 61. The grooves 81 may also be formed in the thread groove spacer 80 while being formed in the outer diameter wall of the rotor body 61.

The vacuum pump 1 further comprises a magnetic bearing 20 for supporting the rotor shaft 18 by magnetic force, and a motor 30 for producing a torque at the rotor shaft 18.

The magnetic bearing 20 is of a five-shaft control type, equipped with: a radial electromagnets 21 and 24 for producing a magnetic force in the radial direction to the rotor shaft 18; radial sensors 22 and 26 for detecting the position of the rotor shaft 18 in the radial direction; axial electromagnets 32 and 34 for producing a magnetic force in the axial direction to the rotor shaft 18; an armature disk 31 on which a magnetic force in the axial direction caused by the axial electromagnets 32 and 34 acts; and an axial sensor 36 for detecting the position of the rotor shaft 18 in the axial direction.

The axial electromagnet 21 is formed of two pairs of electromagnets arranged to be orthogonal to each other. The respective pairs of electromagnets are arranged at position over the motor 30 of the rotor shaft 18 in a face-to-face manner while sandwiching the rotor shaft 18.

Disposed above the radial electromagnet 21 are two pairs of the radial sensors 22 facing each other and sandwiching the rotor shaft 18. Two pairs of the radial sensors 22 are arranged to be orthogonal to each other in correspondent with two pairs of the radial electromagnets 21.

In addition, two pairs of the radial sensors 24 facing each other in a similar manner are disposed beneath the motor 30 of the rotor shaft 18.

Two pairs of the radial sensors 26 adjacent to the radial electromagnet 24 are also provided beneath the radial electromagnet 24.

When an excitation current is supplied to these radial electromagnets 21 and 24, the rotor shaft 18 can be magnetically floated. This excitation current is controlled in response to a position detection signal from the radial sensors 22 and 26, to thereby hold the rotor shaft 18 at a certain position in the radial direction.

The armature disk 31 of a disk-like plate formed of a magnetic material is secured at the lower portion of the rotor shaft 18. A pair of the axial electromagnets 32 and 34 facing each other and sandwiching the armature disk 31 is arranged beneath the rotor shaft 18. The axial sensor 36 is also arranged so as to face the lower end of the rotor shaft 18.

An excitation current supplied to these axial electromagnets 32 and 34 is controlled in response to a position detection signal from the axial sensor 36, to thereby hold the rotor shaft 18 at a certain position in the axial direction.

The magnetic bearing 20 is equipped with a magnetic bearing control section within the control system 45. The magnetic bearing control section individually feed-back controls the excitation current supplied to the radial electromagnets 21 and 24, the axial electromagnets 32 and 34 and the like based on the detection signals from the radial sensors 22 and 26 and the axial sensor 36. As a result, the rotor shaft 18 can be magnetically floated.

The vacuum pump 1 in accordance with the present embodiment can be driven in a clean condition without any concern with dust or undesired gas. This is because the use of the magnetic bearing eliminates the presence of a mechanical contact to generate no dust, or no requirement for sealing oil or the like prevents undesired gas from generating. Such a vacuum pump meets with a high cleanness requirement for manufacturing semiconductors and the like.

In the vacuum pump 1 in accordance with the present embodiment, touch down bearings 38 and 39 are mounted to the top and the bottom of the rotor shaft 18, respectively, In general, the rotor shaft 18 and the rotor section constituted by components equipped therewith are axially supported to the magnetic bearing 20 in a non-contact manner while being rotated by the motor 30. The touch down bearings 38 and 39 instead of the magnetic bearing 20 axially support the rotor section in the case where touch-down occurs, so that the entire apparatus can be protected.

Accordingly, the touch down bearings 38 and 39 are so arranged that the inner race of each bearing may not be brought into contact with the rotor shaft 18.

The motor 30 is disposed substantially at the center position in the axial direction of the rotor shaft 18 between the radial sensor 22 and the radial sensor 26 within the outer casing 10. An electrical conduction of the motor 30 allows the rotor shaft 18, and the rotor 60 and rotor blade 62 fixed thereto, to be rotated. The rpm of the rotation is detected by an rpm sensor 41, and then controlled by the control system 45 based on the signal sent from the rpm sensor 41.

An outlet port 17 for discharging gas delivered by the thread groove pump section S to the outside is arranged in the lower portion of the outer casing 10 in the vacuum pump 1.

Further, the vacuum pump 1 is connected to the control system 45 through a connector and a cable.

The vacuum pump 1 in accordance with the present embodiment is also equipped with a conductance variable mechanism 50 at an inlet port 16 formed inside the flange 11. The conductance variable mechanism 50 allows the sectional area relative to the delivered direction of gas to increase or decrease, changing the flow rate of gas. Therefore, it serves as gas flow rate changing means for adjusting an amount of gas to be sucked from the inlet port 16.

Figure 4A:
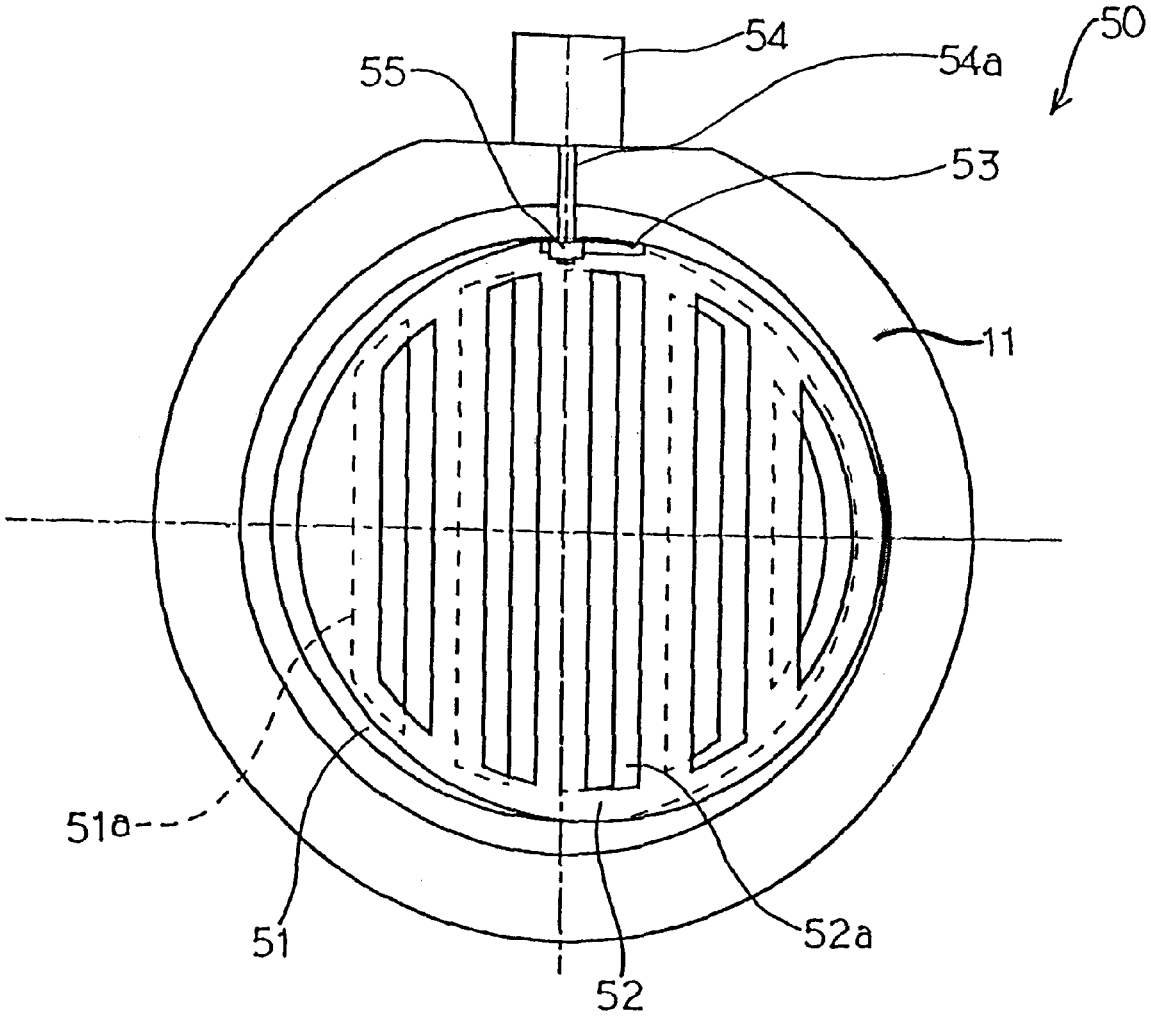
FIGS. 4A and 4B show an outline of the structure of a conductance variable mechanism in the vacuum pump shown in FIG. 1.
Figure 4B:
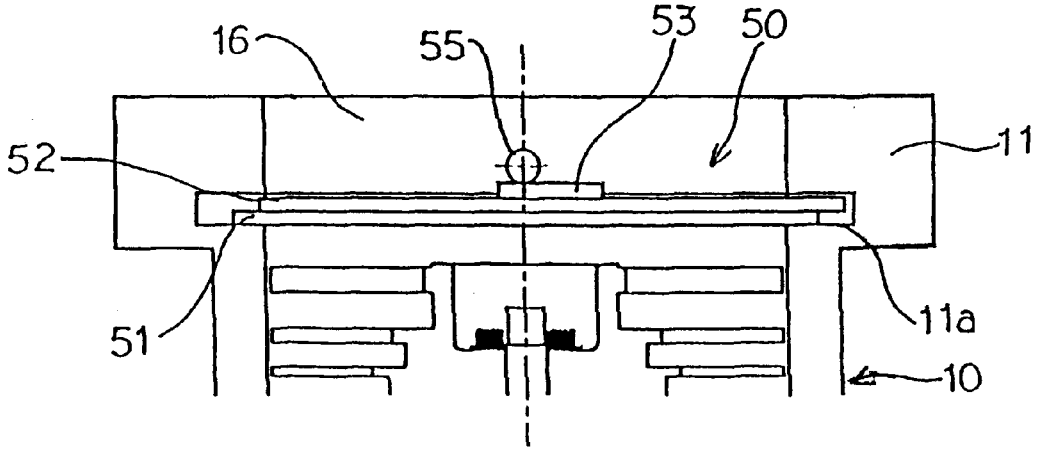

FIG. 4 generally show an outline of the structure of the conductance variable mechanism 50 in which FIG. 4A is a top plan view and FIG. 4B is a sectional view showing the conductance variable mechanism 50 equipped with the vacuum pump, respectively.

As shown in FIG. 4A, the conductance variable mechanism 50 is provided with a stationary plate 51 and a movable plate 52, both of which are disk-like plates. The stationary plate 51 is arranged such that the peripheral edge thereof is fixed to a stepped portion lla formed on the inner peripheral wall of the flange 11 and the plane portion thereof is arranged so as to be vertical to the rotation axis of the pump. The movable plate 52 is arranged at the stationary plate 51 with a slight gap therebetween.

These valve plates (stationary plate 51 and the movable plate 52) are formed with a plurality of openings 51*a* and 52*a* in parallel with each other in the radial direction. These openings 51*a* and 52*a* overlap with each other to thereby form a passage for passing gas. The openings 51*a* and 52*a*' each have a width of 20 mm or less. When the conductance variable mechanism has such openings for forming the passage for gas, each opening having a shorter side of 20 mm or less, undesired foreign materials can be prevented from dropping into the pump.

A rack gear 53 is fixed to the top surface of the movable plate 52 at the edge thereof. A stepping motor 54 is arranged externally to the flange 11, and the tip of a shaft 54*a* for the stepping motor 54 is arranged above the rack gear 53 so as to be inserted into the flange 11. A pinion 55 is coaxially fixed to the top of the shaft 54*a*, and the pinion 55 is meshed with the rack gear 53.

When the stepping motor 54 is controlled and driven in response to the signal from the control system 45, the driving force is transmitted to the movable plate 52 through the pinion 55 and the rack gear 53. Then, the movable plate 52 may slide on the top surface of the stationary plate 51, allowing the area of the portion where the openings 51*a* and 52*a* overlap with each other to change. As a result, the area of the cross-section of the passage for gas may be changed.

Figure 5A:
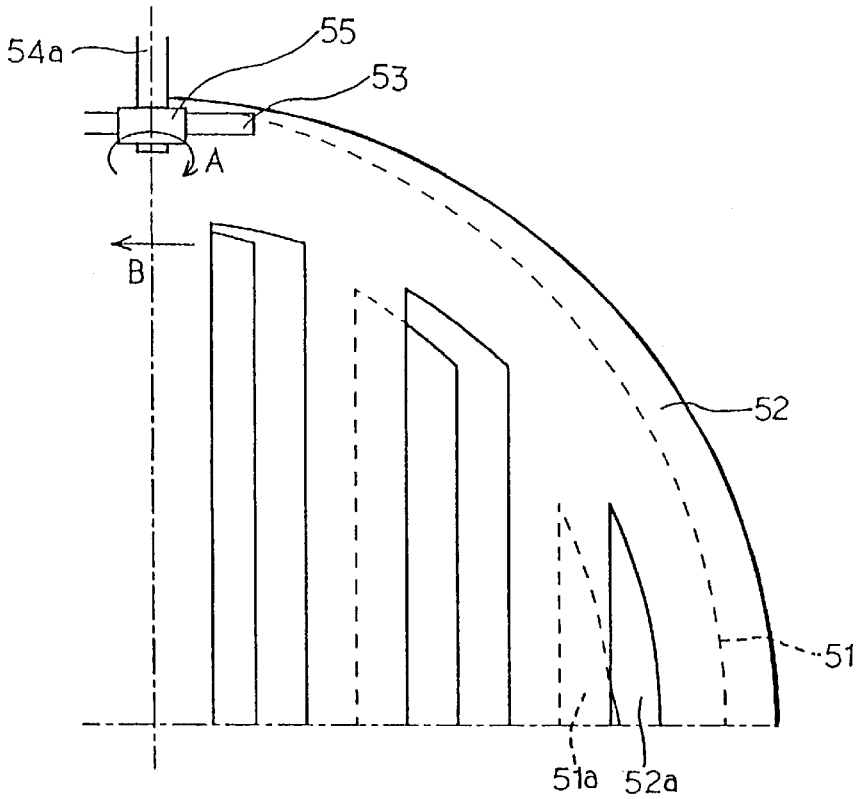
FIGS. 5A and 5B are plan views showing the conductance variable mechanism shown in FIGS. 4*a* and 4*b*, which is closed and opened, respectively.
Figure 5B:
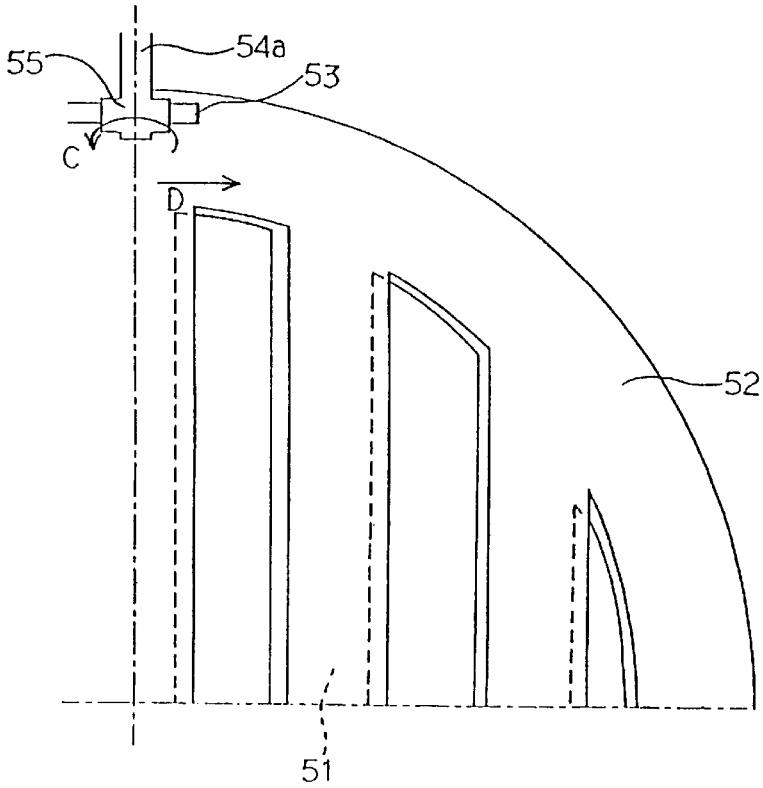

FIGS. 5A and 5B are plan views showing opened and closed state of the conductance variable mechanism 50, in which FIG. 5A shows the conductance variable mechanism 50 in the most closing state, and FIG. 5B shows the conductance variable mechanism 50 in the most opening state.

In the present embodiment, as shown in FIG. 5A, the movable plate 52 is arranged such that the movable plate 52 is most deviated from the stationary plate 51. Even with the condition where the openings 51*a* and 52*a* are not most overlapped with each other so that the conductance variable mechanism 50 is in the most closed state, the openings 51*a* and 52*a* are slightly overlapped with each other. The passage for gas can be thus assured.

Under such a condition, when the stepping motor 54 is driven to rotate the pinion 55 in the direction indicated by the arrow A in the figure through the shaft 54*a*, the movable plate 52 is moved in the direction indicated by the arrow B in the figure through the rack gear 53. Accordingly, there is an increase in area of the portion where the openings 51*a* and 52*a* in these two plates are overlapped with each other. Therefore, the are of the cross-section of the passage for gas is increased, to widen the passage for gas, so that an amount of sucking gas into the vacuum pump 1 can be increased.

FIG. 5B shows the state where the movable plate 52 slides by the far distance in the direction indicated by the arrow B in FIG. 5A, where the passage for gas is most widened.

On the other hand, when the stepping motor 54 is driven in the reverse direction to rotate the pinion 55 in the direction indicated by the arrow C in FIG. 5B through the shaft 54*a*, the movable plate 52 is moved in the direction indicated by the arrow D in the figure through the rack gear 53. Accordingly, there occurs a decrease in area of the portion where the openings 51*a* and 52*a* in these two plates are overlapped with each other. Therefore, the area of the cross-section of the passage for gas is reduced, to thereby narrow the passage for gas. As a result, the pressure of gas is increased at the upstream side of the conductance variable mechanism 50 in gas flow. An amount of sucking gas into the vacuum pump 1 can be thus decreased.

It is to be noted that the stepping motor 50 is driven, thereby allowing the movable plate 52 to be arranged in the midway of the distance from the position of FIG. 5A to the position of FIG. 5B.

A description will now be made of an embodiment of a vacuum apparatus according to the present invention, which employs the vacuum pump 1 in accordance with the foregoing embodiment. It will be noted in this embodiment that the same members as those in the conventional vacuum apparatus as shown in FIG. 6 are described using the same reference numerals, and the descriptions thereof are omitted.

Figure 6:
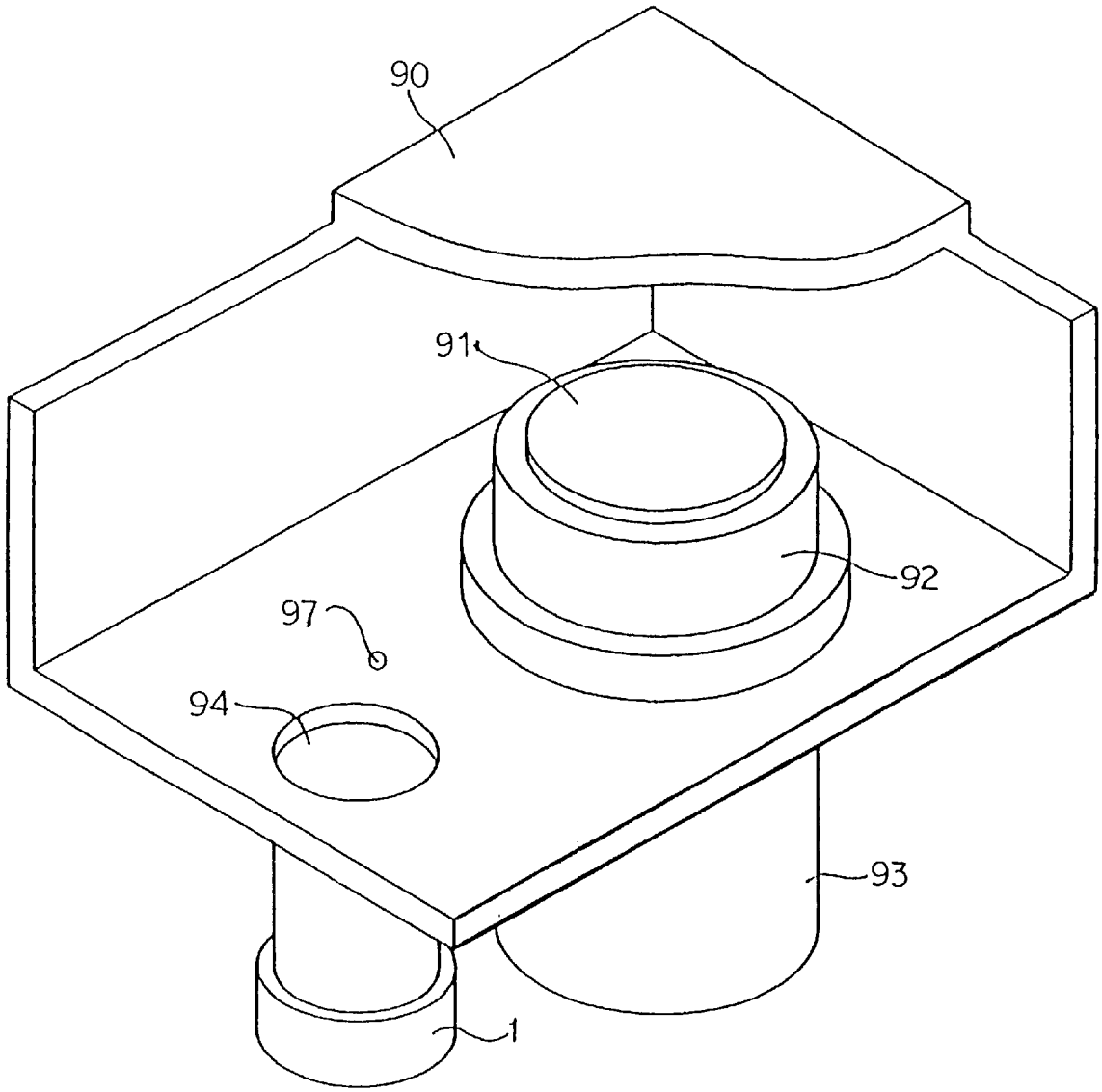
FIG. 6 is a schematic perspective view showing the structure of a vacuum apparatus according to an embodiment of the present invention.

FIG. 6 is a perspective view showing an outline of the structure of a vacuum apparatus according to an embodiment of the present invention.

As shown in FIG. 6, in the vacuum apparatus of the present invention, a pressure sensor 97 is provided within a chamber 90 for detecting a pressure in the chamber 90.

The pressure sensor 97 is connected to the control system 45 via a connector and a cable for outputting a signal in response to the pressure from the pressure sensor 97 to the control system 45.

Also, in this vacuum apparatus, a vacuum pump 1 is attached to an exhaust port 94 of the chamber 90 in a direct manner without intermediating a valve.

In the vacuum pump 1 and the vacuum apparatus having such an arrangement, as a rotor 60 is rotated at a high speed of a rated value (20,000 to 50,000 rpm) by a motor 30, a rotor blade 62 can be also rotated at a high speed. This allows the process gas or the like within in the chamber 90 to be delivered through the rotor blade 62 and the thread groove 81 through the exhaust port 94 and the inlet port 16 of the vacuum pump 1. Then, gas can be discharged from the outlet port 17.

Figure 7:
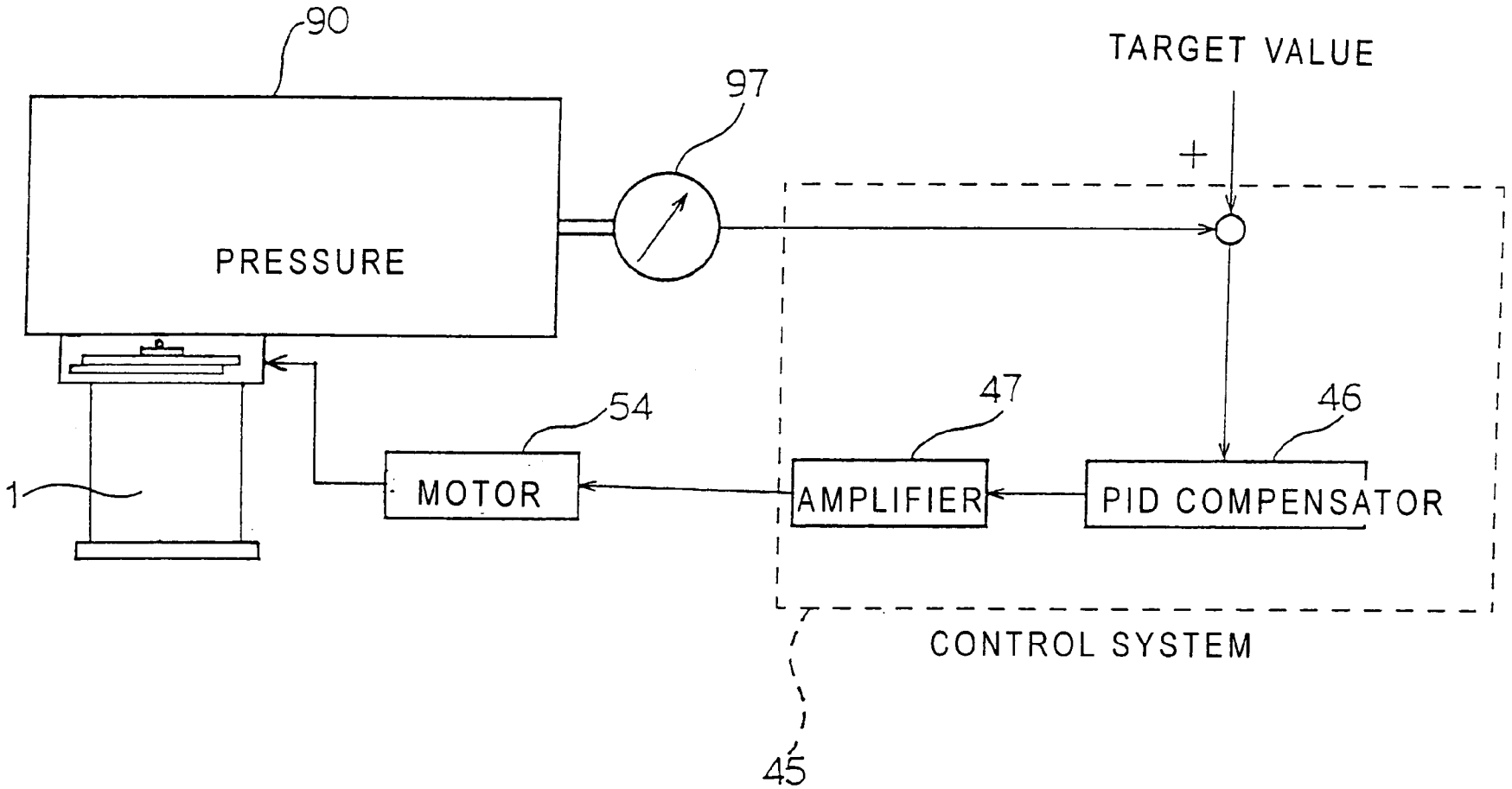
FIG. 7 is a block diagram showing a control system for controlling a pressure within a chamber in the vacuum apparatus shown in FIG. 6.

FIG. 7 is a block diagram showing a control system for controlling a pressure within the chamber 90 in the vacuum apparatus in accordance with the present embodiment.

As shown in FIG. 7, a signal in respond to the pressure from the chamber 90 is outputted to the control system 45. The control system 45 compares the signal with a target value, where a difference therebetween is outputted to a PID compensator 46. A control signal of the value corresponding to a difference from the target value is outputted by the PID compensator 46, amplified by an amplifier 47, and then outputted to the stepping motor 54 for driving a valve.

The stepping motor 54 is driven on the basis of the input signal to slide the movable plate 52 via the pinion 55 and the rack gear 53.

More specifically, when the pressure in the vicinity of the pressure sensor 97 is low, the stepping motor 54 is driven to rotate the pinion 55 in the direction indicated by the arrow C in FIG. 5 on the basis of the control signal from the control system 45. The movable plate 52 as well as the rack gear 53 is then moved in the direction indicated by the arrow D in FIG. 5. The portion where the openings 51*a* and 52*a* in the movable plate 52 and the stationary plate 51 are overlapped with each other is narrowed to decrease an amount of flowing gas into the turbomolecular pump section T from the inlet port 16 while the pressure at the upstream side of the conductance variable mechanism 50 is increased. Therefore, the sucking performance of gas within the chamber 90 is reduced while the pressure within the chamber 90 is increased.

On the other hand, when the pressure in the vicinity of the pressure sensor 97 is high, the stepping motor 54 is driven to rotate the pinion 55 in the direction indicated by the arrow A in FIG. 5, and the movable plate 52 and the rack gear 53 are moved in the direction indicated by the arrow B in FIG. 5. The portion where the openings 51*a* and 52*a* in the movable plate 52 and the stationary plate 51 are overlapped with each other, is widened to increase an amount of gas fed into the turbomolecular pump section T from the inlet port 16. Then, the pressure at the upstream side of the conductance variable mechanism 50 is decreased. Therefore, the sucking performance of gas within the chamber 90 is improved while the pressure within the chamber 90 is decreased.

As described above, according to the present embodiment, the conductance variable mechanism 50 is provided at the inlet port 16 in the vacuum pump 1. This conductance variable mechanism 50 allows the sectional area of the gas passage at the inlet port 16 relative to the gas feeding direction to increase or decrease, to adjust an amount of gas sucked into the vacuum pump 1. Therefore, according to the present embodiment, there is no need to provide a valve as an intermediate between the vacuum pump 1 and the chamber 90, thereby reducing the space for installing the apparatus. Also, the manufacturing cost for the entire vacuum apparatus is reduced, and an assembling thereof does not take much time.

According to the present embodiment, in the conductance variable mechanism 50, an overlapped portion of openings 91*a* and 92*a* in two valve plates are used as the gas passage, and either of two plates is slid to allow the overlapped portion of the openings to increase/decrease in sectional area of gas passage. Therefore, the conductance variable mechanism 50 has a merely small thickness required for disposing and driving the conductance variable mechanism 50. The conductance variable mechanism 50 can be arranged without height at the inlet port 16 in the vacuum pump 1 being largely increased. According to the present embodiment, therefore, in particular, space can be saved for installing the apparatus, and the exhaustion performance can be prevented from lowering since the conductance may not be reduced.

In this embodiment, the pressure sensor 97 for detecting the pressure within the chamber 90 is provided, and the opening/closing amount of the conductance variable mechanism 50 is determined on the basis of the output from the pressure sensor 97 to control the flow rate of gas. The pressure within the chamber 90 may thus be adjusted to have a desired value with efficiency and accuracy.

It is to be noted that the vacuum pump of the present invention and the vacuum apparatus of the present invention are not limited to the embodiment described above, but may be properly modified as long as the modification does not depart from the spirit of the present invention.

For instance, the conductance variable mechanism as a mechanism for increasing and decreasing the passage area is not limited to the one of the slide plate type as in the embodiment above. Examples of adaptable mechanism include a conductance variable mechanism of rotation plate type, a butterfly valve, a conductance variable mechanism with angle-variable blades, a conductance variable mechanism of camera diaphragm type, and other conductance variable mechanism.

Figure 8A:
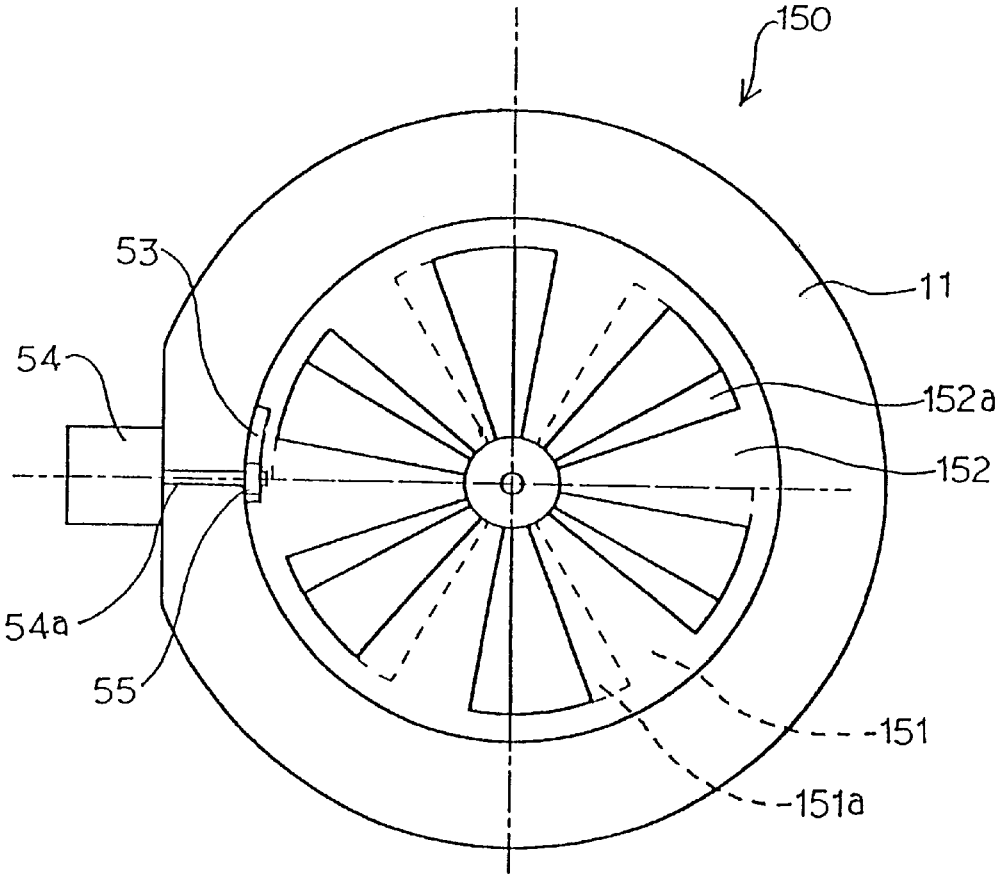
FIGS. 8A and 8B are views showing an outline of the structure of a main portion of a vacuum pump according to another embodiment of the present invention.
Figure 8B:
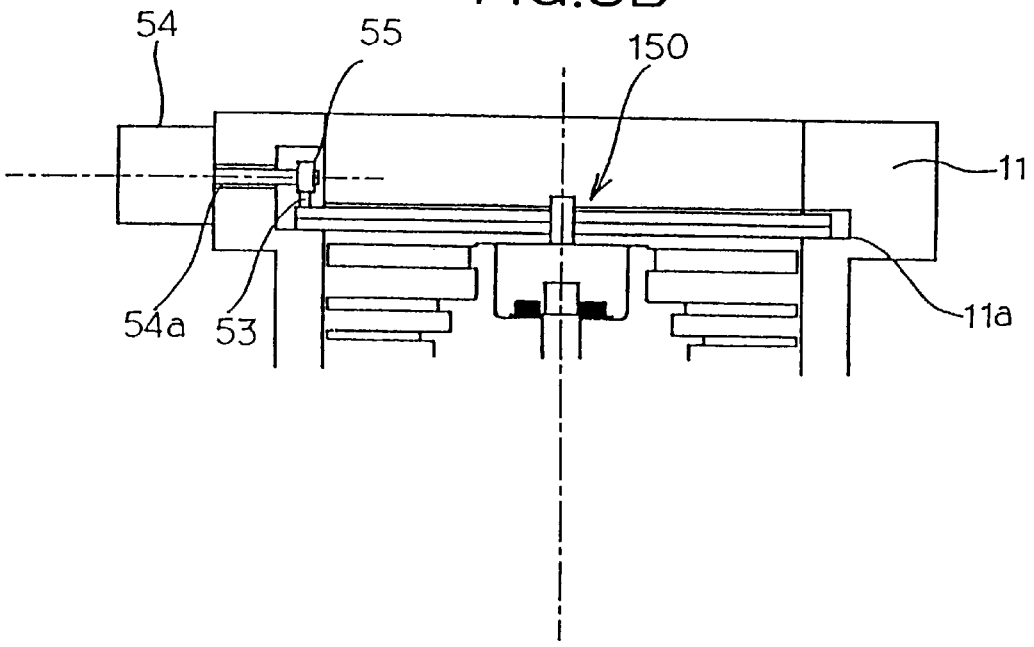

FIGS. 8A and 8B show an embodiment of the vacuum pump according to the present invention, in which the rotation plate type is used as the conductance variable mechanism. FIG. 8A is a plan view showing an outline of the structure of the conductance variable mechanism of the rotation plate type, and FIG. 8B is a view showing a cross section of a main part of the vacuum pump according to an embodiment of the present invention in which the rotation plate type is used as the conductance variable mechanism.

As shown in FIGS. 8A and 8B, a rotation plate type conductance variable mechanism 150 comprises two disk-like plates (a fixed plate 151 and a rotation plate 152). Each of the disk-like plates has a through hole formed at the center thereof, and a plurality of opening portions 151*a* and 152*a* which are radially extended and have fan-like shapes when seen from the top. One of the plates (fixed plate 151) is fixed at its periphery to the inner wall of the flange 11. And the other plate (rotation plate 152) is fixed at its center with a pin to be rotatably placed on the fixed plate 151. A passage for gas is formed when the opening portions of these two plates are overlapped with each other. The rack gear 53 is fixed to the upper surface of the rotation plate 152 at the periphery, and above this rack gear 53, a tip of the shaft 54*a* of the stepping motor 54 disposed outside the flange 11 is arranged so as to pierce the flange 11. The pinion 55 is coaxially fixed to the tip of the shaft 54*a*, and is intermeshed with the aforementioned rack gear 53.

The stepping motor 54 is driven with a signal from the control system 45, and driving force thereof is transmitted to the rotation plate 152 via the pinion 55 and the rack gear 53 to rotate the rotation plate 152 about the rotor axis on the fixed plate 151, thereby changing the area of overlapped opening portions 151*a* and 152*a* of the two plates and causing a change in sectional area of the passage for gas.

Such a rotation plate type conductance variable mechanism 150 may also be disposed with a reduced thickness, and the thickness of the inlet port 16 portion in the vacuum pump 1 may be reduced in a gas feeding direction, which makes it possible to realize a vacuum pump and a vacuum apparatus requiring a smaller space for installation.

Figure 9A:
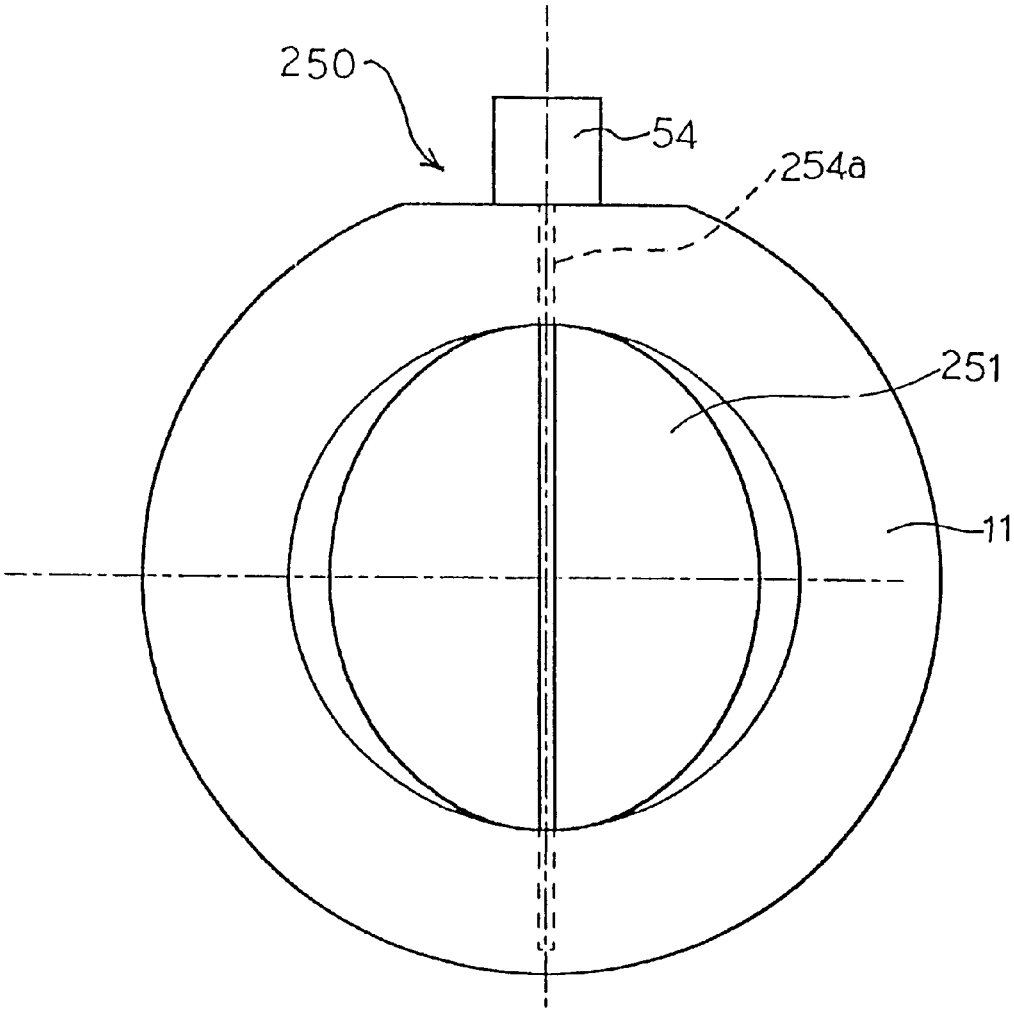
FIGS. 9A and 9B are views showing an outline of the structure of a main portion of a vacuum pump according to still another embodiment of the present invention.
Figure 9B:
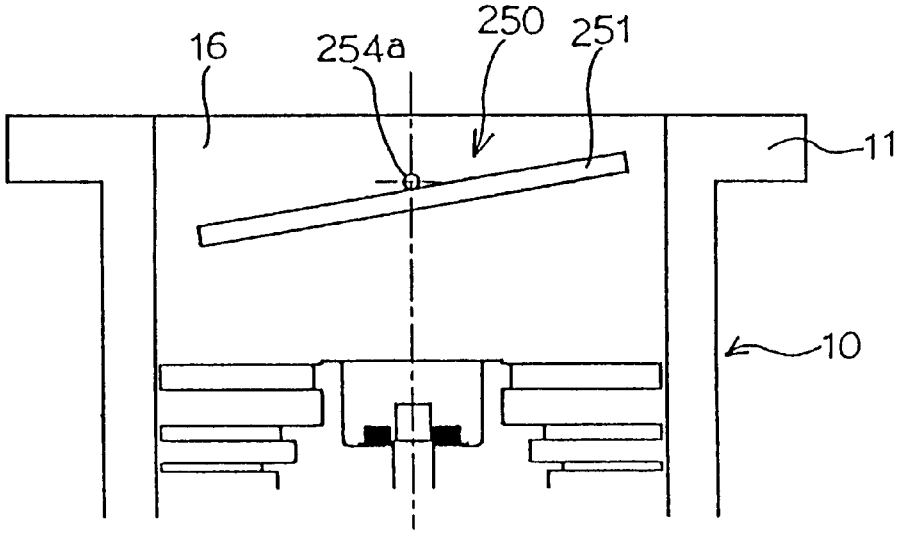

FIGS. 9A and 9B show the vacuum pump according to an embodiment of the present invention, in which the butterfly valve is used as the conductance variable mechanism. FIG. 9A is a plan view showing an outline of the structure of the butterfly valve, and FIG. 9B is a view showing a cross-section of a main part of the vacuum pump according to an embodiment of the present invention in which the butterfly valve is used.

As shown in FIGS. 9A and 9B, a butterfly valve 250 is provided with a disk-like butterfly valve 251, so that the gap between the inner wall of the flange 11 and the butterfly valve 251 forms the passage for gas. A shaft 254*a* that rotates synchronously with the stepping motor 54 provided outside the flange 11 is arranged so as to pierce the inner space of the flange 11, and is fixed to the upper surface of the butterfly valve 251 along its lengthwise axial line. The rotation of this shaft causes increase or decrease in the sectional area of the passage for gas.

Figure 10A:
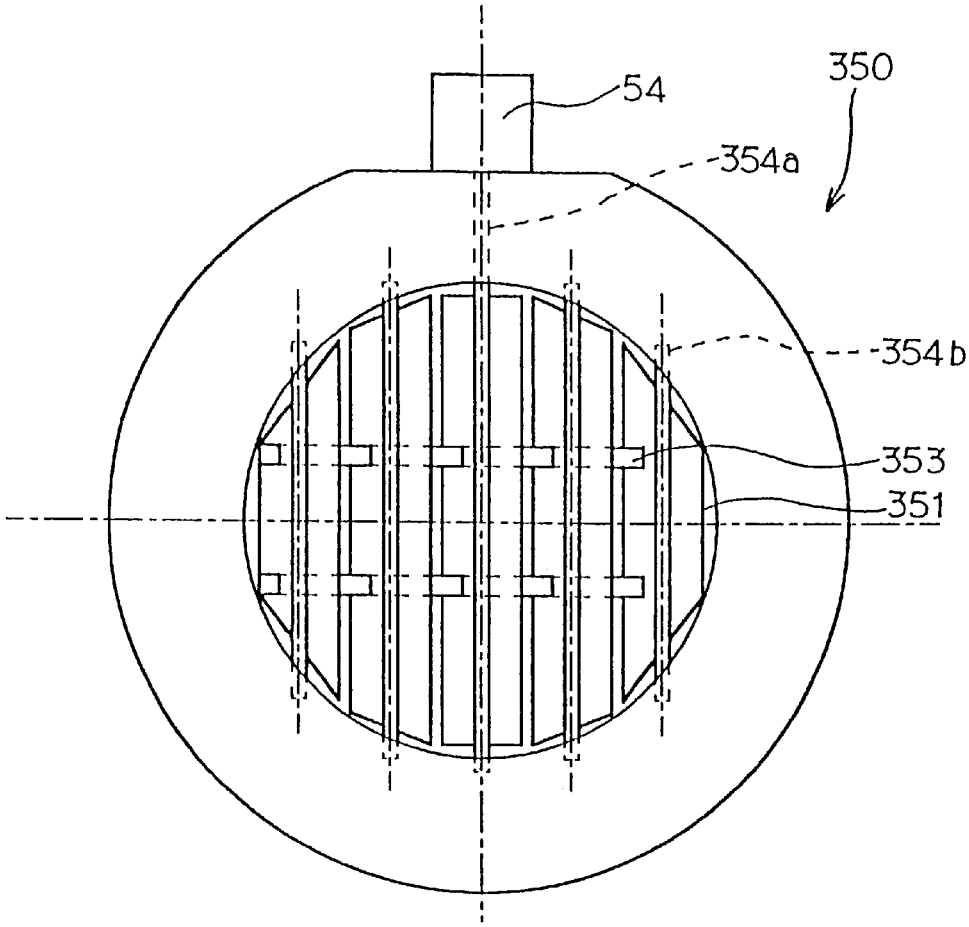
FIGS. 10A and 10B are views showing an outline of the structure of a main portion of a vacuum pump according to still another embodiment of the present invention.
Figure 10B:
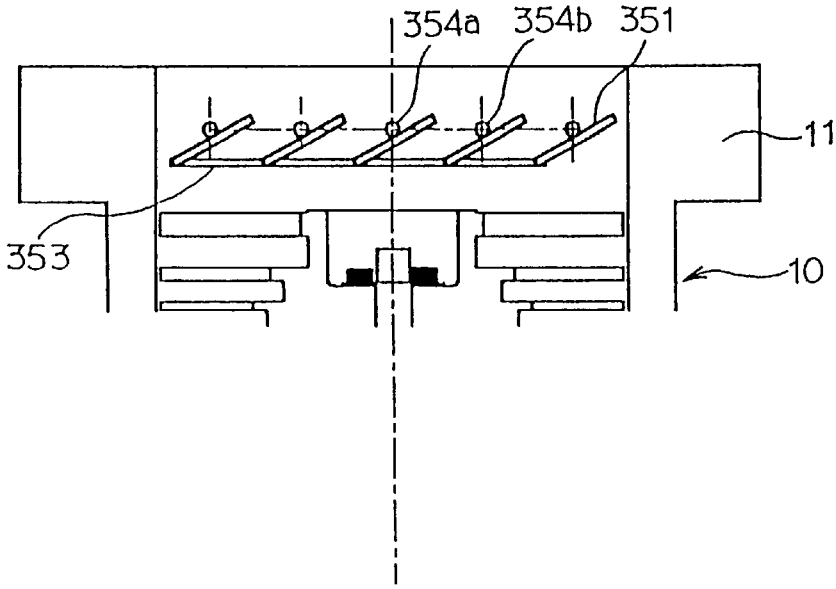

FIGS. 10A and 10B shows an embodiment of the vacuum pump according to the present invention in which the conductance variable mechanism with angle-variable blades is employed as the conductance variable mechanism. FIG. 10A is a plan view showing an outline of the structure of the conductance variable mechanism with angle-variable blades. FIG. 10B is a view showing a cross-section of a main part of the vacuum pump according to the embodiment of the present invention, in which the conductance variable mechanism with angle-variable blades.

As shown in FIGS. 10A and 10B, in a conductance variable mechanism 350 with angle-variable blades, a shaft 354*a* that rotates synchronously with the stepping motor 54 provided outside the flange 11 comes across the inner space of the flange 11 to be rotatably supported to the flange 11. A plurality of supporting shafts 354*b* arranged in parallel to the shaft 354*a* come across the inner space of the flange 11 to be rotatably supported to the flange 11. Resistance blades 351 are fixed to the shaft 354*a* and the supporting shafts 350*b*, respectively. The intervals between the resistance blades and the clearances between the blades and the flange 11 form the passages for gas. The resistance blades 351 are coupled to two common link plates. Therefore, when the shaft 354*a* is rotated and the resistance blade 351 fixed to the shaft 354*a* is caused to rotate, the other resistance blades 351 are synchronously rotated via the link plates 353, thereby increasing or decreasing the sectional area of the passages for gas.

The butterfly valve 250 and the conductance variable mechanism 350 with angle-variable blades described above rarely block the passage for gas when they are fully opened, and hence have advantages in that the sucking performance of the vacuum pump 1 is utilized particularly well.

Figure 11A:
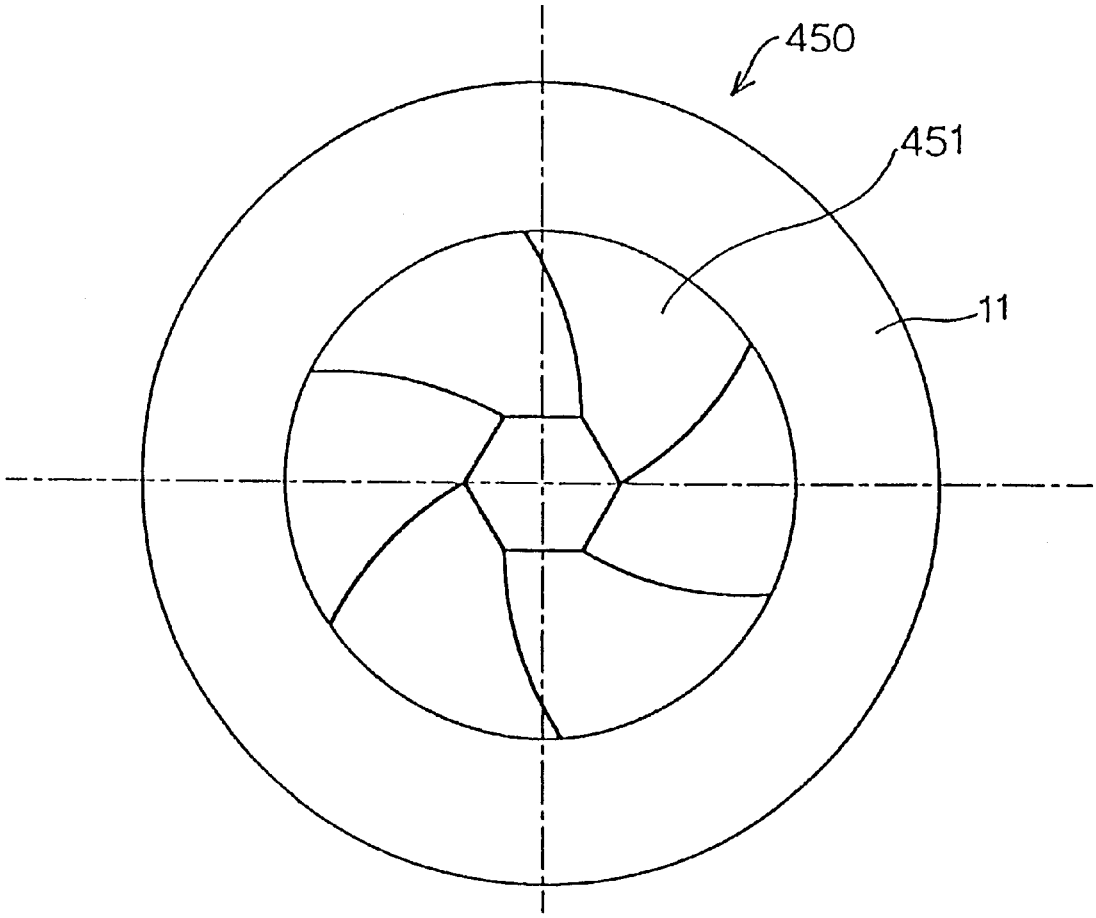
FIGS. 11A and 11B are views showing an outline of the structure of a main portion of a vacuum pump according to still another embodiment of the present invention.
Figure 11B:
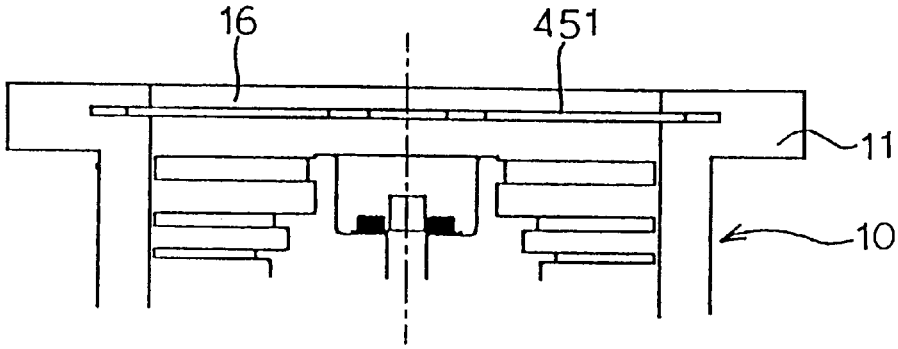

FIGS. 11A and 11B show an embodiment of the vacuum pump according to the present invention, in which the conductance variable mechanism of camera diaphragm type is used as the conductance variable mechanism. FIG. 11A is a plan view showing an outline of the conductance variable mechanism of camera diaphragm type. FIG. 11B is a view showing a cross-section of a main part of the vacuum pump according to the embodiment of the present invention, in which the conductance variable mechanism of camera diaphragm type is used.

As shown in the FIGS. 11A and 11B, a conductance variable mechanism 450 of camera diaphragm type is provided with a plurality of shutter valves 451 that may reciprocate from the flange 11 side toward the axial line. Adjacent valves of these shutter valves 451 synchronously reciprocate while keeping contact with each other. An area about the axial line reaching the edges of the shutter valves 451 is opened to form a passage for gas. The reciprocating motion of the shutter valves 451 is accompanied with decrease or increase in the sectional area of the passage for gas.

Two plates are used in the conductance variable mechanism 50 according to the embodiment described above. However, the mechanism is not limited thereto. Larger number of plates may be used in the conductance variable mechanism 50 according to the embodiment described above and the conductance variable mechanism 150 of rotation plate type, which is a modification example thereof. In this case, the openings 51*a*, 52*a*, 151*a* and 152*a* may have larger spaces to enlarge the sectional areas of the passages for gas at the time of full opening, thereby being capable of appropriately utilizing the sucking performance of the vacuum pump 1.

A protective wire netting may be omitted by making other components to take on its blocking function against a foreign matter falling into the mechanism. The above-mentioned advantages are attained by, in the case of conductance variable mechanism 50 according to the embodiment described above or in the conductance variable mechanism 150 of rotation plate type which is a modification example thereof, respectively, dividing the openings 51*a*, 52*a*, 151*a* and 152*a* of the plates to provided a larger number of openings, or by, in the case of the conductance variable mechanism with anglevariable blades, shortening the width of each blade 351 to provide a larger number of blades.

In the embodiment and the modification example described above, the passage for gas is not completely closed. However, the passage may be completely closed by modifying the shape of the opening or the shapes of the butterfly valve and the shutter valve.

The conductance variable mechanism 50 as the mechanism for increasing or decreasing the passage area is provided at the inlet port. However, the place is not limited thereto but may be at the gas feeding portion or an outlet port 17.

Figure 12:
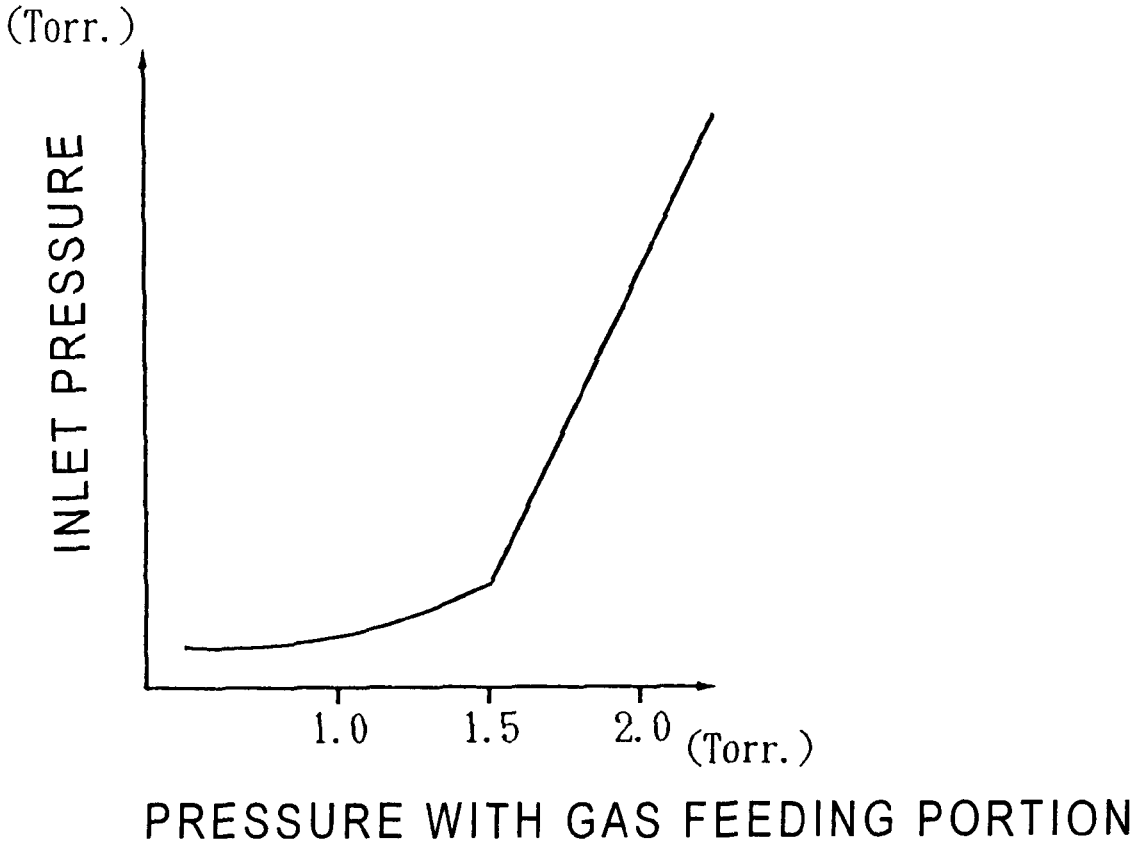
FIG. 12 is a graph indicating a relationship between an atmospheric pressure within a gas feeding portion and an atmospheric pressure at an inlet port in the vacuum pump.

FIG. 12 is a graph showing a relationship between the pressure within a gas feeding portion (gas passage of the turbomolecular pump section T and thread groove pump section S) of the vacuum pump 1 and the pressure at the inlet port 16. As shown in the graph, increased pressure in the gas feeding portion of the vacuum pump 1 increases also the pressure at the inlet port 16 to weaken the power of sucking gas. When the air pressure in the gas feeding portion is equal to or exceeds the predetermined value (about 1.5 to 2.0 Torr.), the suction force of the vacuum pump 1 may be adjusted with particular efficiency at the air pressure equal to or exceeding this predetermined value because of the increased pressure following the increase of the air pressure in the gas feeding portion. Accordingly, provision of a flow rate controlling means such as the mechanism for increasing or decreasing the passage area in the gas feeding portion or the outlet port 17 makes it possible to adjust the air pressure in the gas feeding portion, and to control the suction force of the vacuum pump 1.

Provision of the flow rate controlling means in the gas feeding portion or the outlet port 17 thus has an advantage in that dusts produced upon the operation start of the flow rate controlling means, are prevented without fail from flowing adversely into the chamber 90.

By way of an example in which the conductance variable mechanism as the mechanism for increasing or decreasing the passage area is disposed in the gas feeding portion, FIGS. 13A to 14C show the thread groove pump section S or what disposed on the upstream side thereof.

Figure 13A:
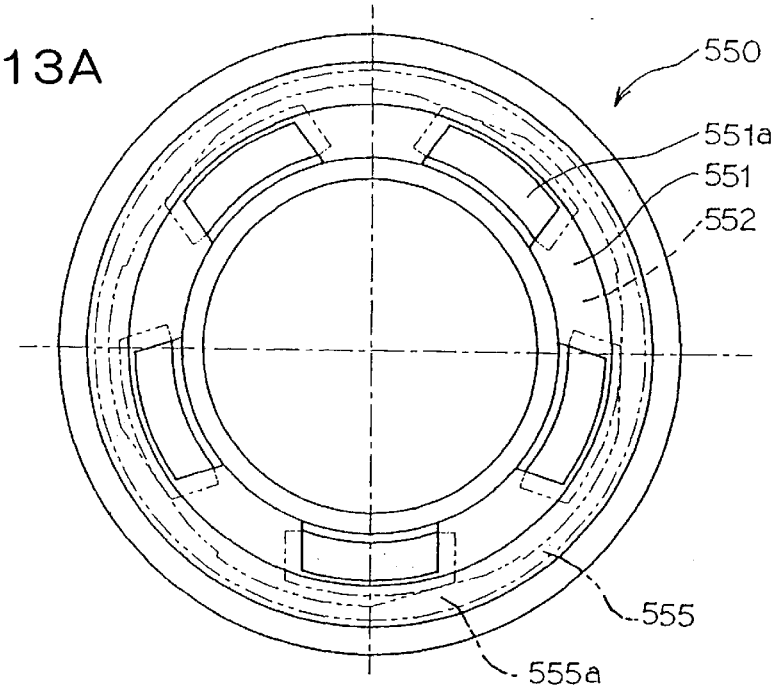
FIGS. 13A to 13C are views showing an outline of the structure of a main portion of a vacuum pump according to still another embodiment of the present invention.
Figure 13B:
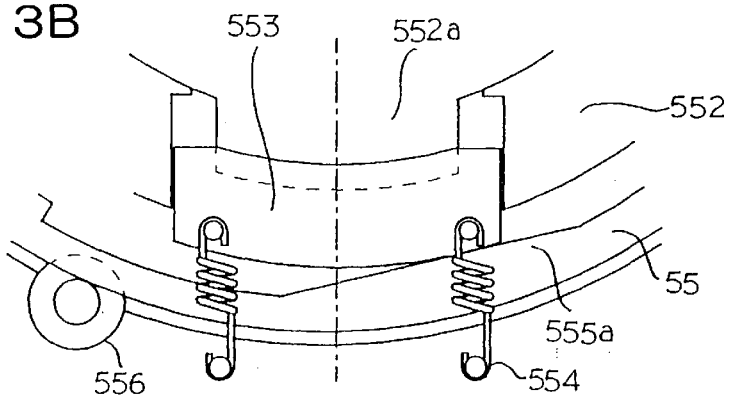
Figure 13C:
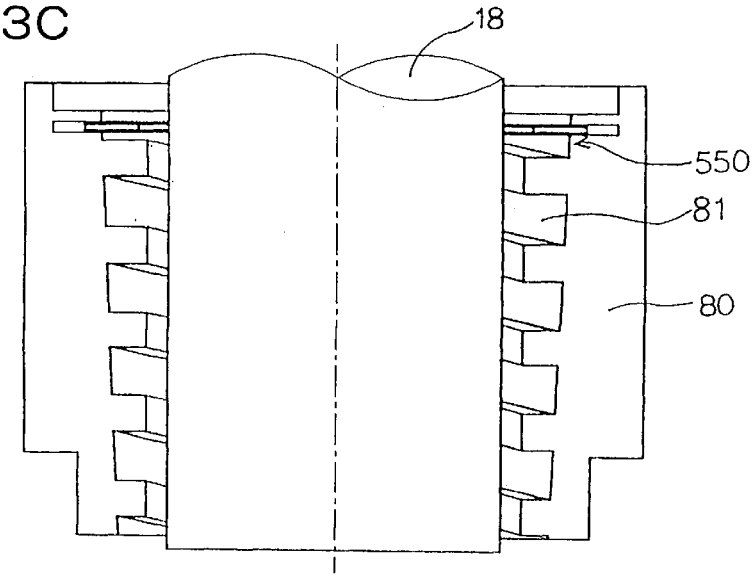

FIGS. 13A to 13C are views showing one example according to an embodiment of the vacuum pump of the present invention having the conductance variable mechanism provided in the gas feeding portion. FIG. 13A is a plan view showing an outline of the structure of the conductance variable mechanism. FIG. 13B is a plan view showing a main part of the conductance variable mechanism. FIG. 13C is a view showing a cross-section of a main part of the vacuum pump according to the embodiment of the present invention, in which the conductance variable mechanism is employed.

A conductance variable mechanism 550 shown in FIGS. 13A to 13C comprises: a lid member provided with ventilation holes 551*a* at positions corresponding to the thread groove 81 of the thread groove spacer 80; a ring-shaped guide member 552 arranged under the lid member 551 so as to make surfacecontact with the lid, and having in its inner periphery cut away portions 552*a* for joining the ventilation holes 551*a* of the lid member 551 to the thread groove 81 to form the passages for gas; shutter valves 553 reciprocatingly supported in the radial direction to the guide member 552 above the cut away portions 552*a*; pulling springs 554 for biasing the shutter valves 553 towards the outer casing 10; and a cam ring 555 provided with a cam portion 555*a* for pushing the shutter valves 553 towards the rotor shaft 18 to move the valves forward against the biasing force of the pulling springs 554. The driving force by the stepping motor 54 is transmitted via a gear 556 that intermeshes with the cam ring 555 to rotate the cam ring 555 and to position the cam portion 555*a* behind shutter valves 553, the shutter valves 553 is moved forward by the positioned cam portion 555*a* to narrow the passage for gas, and, as the cam portion 555*a* shifts its position from behind the shutter valves 553, the shutter valves 553 retreat owing to the biasing force from the pulling springs 554 to increase the sectional area of the passage for gas.

Figure 14A:
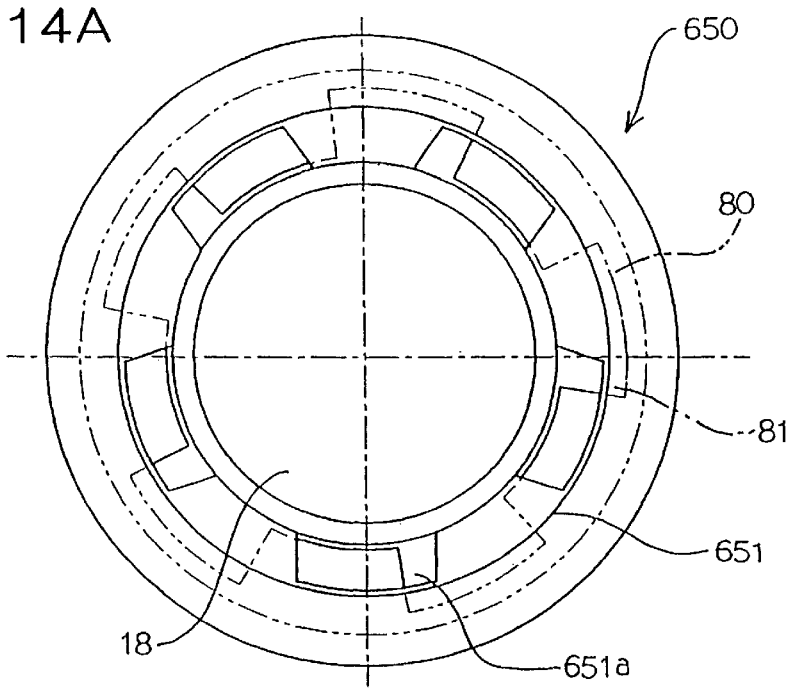
FIGS. 14A to 14C are views showing an outline of the structure of a main portion of a vacuum pump according to still another embodiment of the present invention.
Figure 14B:
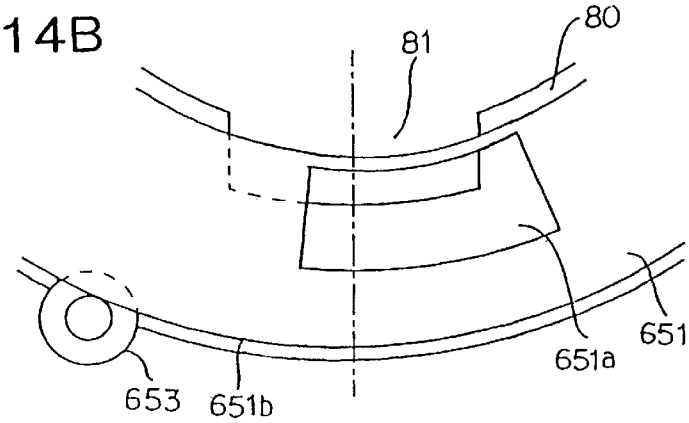
Figure 14C:
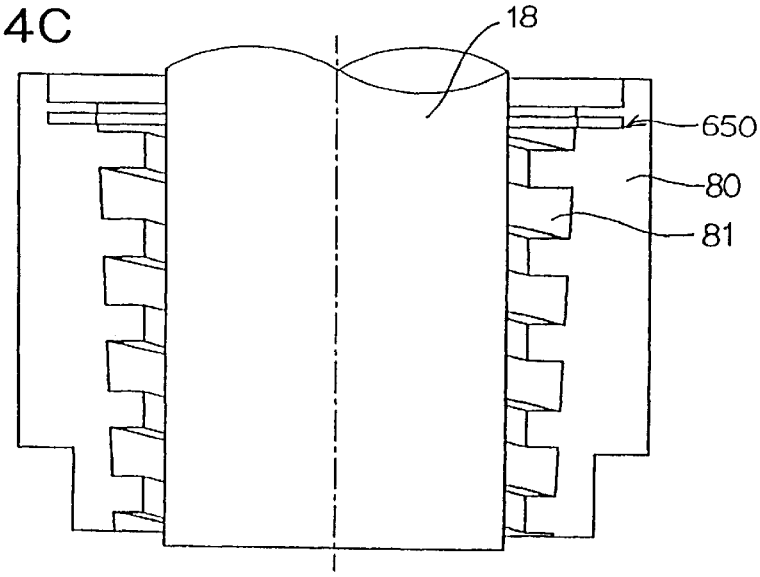
Figure 15:
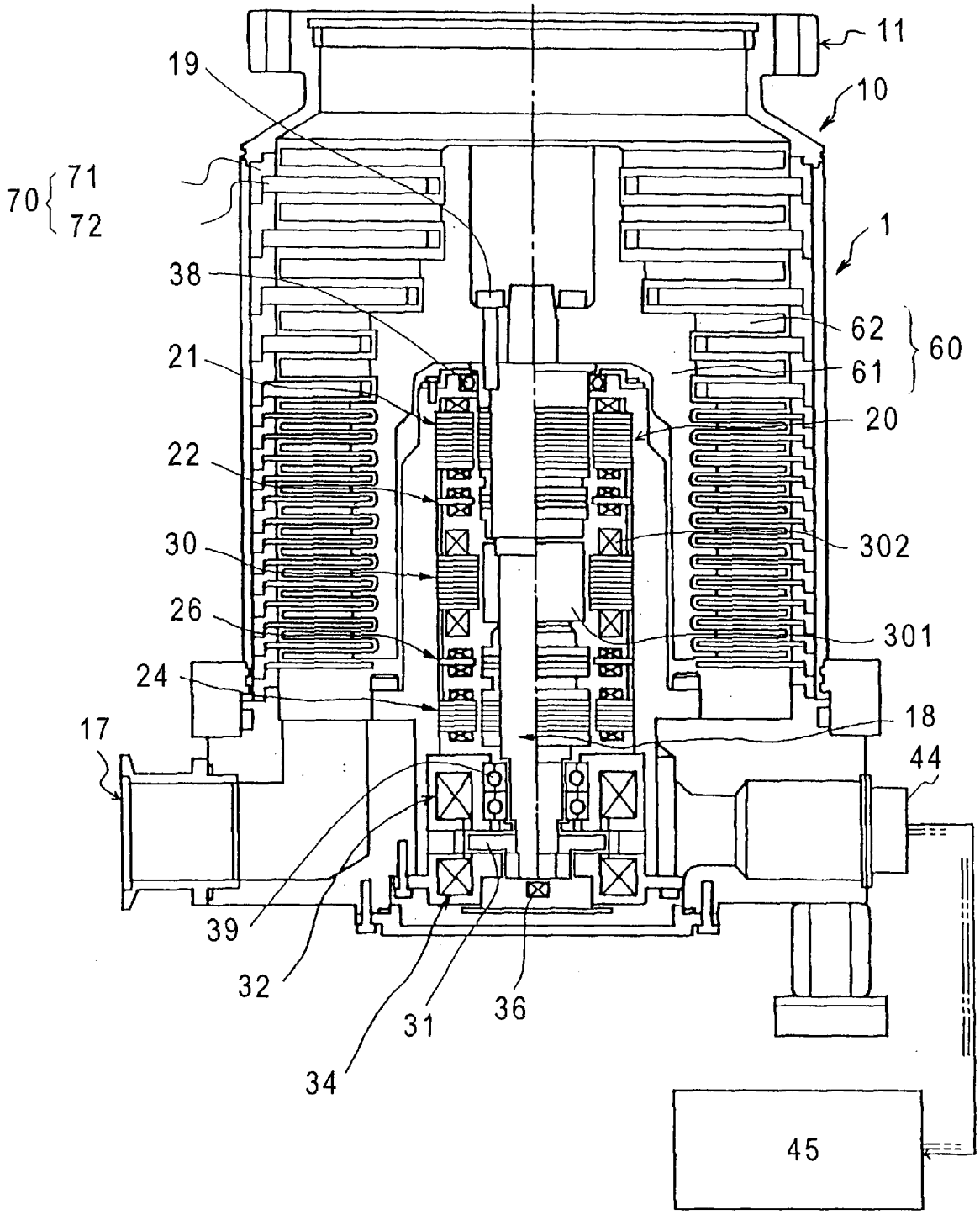
FIG. 15 is a sectional view showing the structure of a turbomolecular pump taken as an example of the conventional vacuum pumps.
Figure 16:
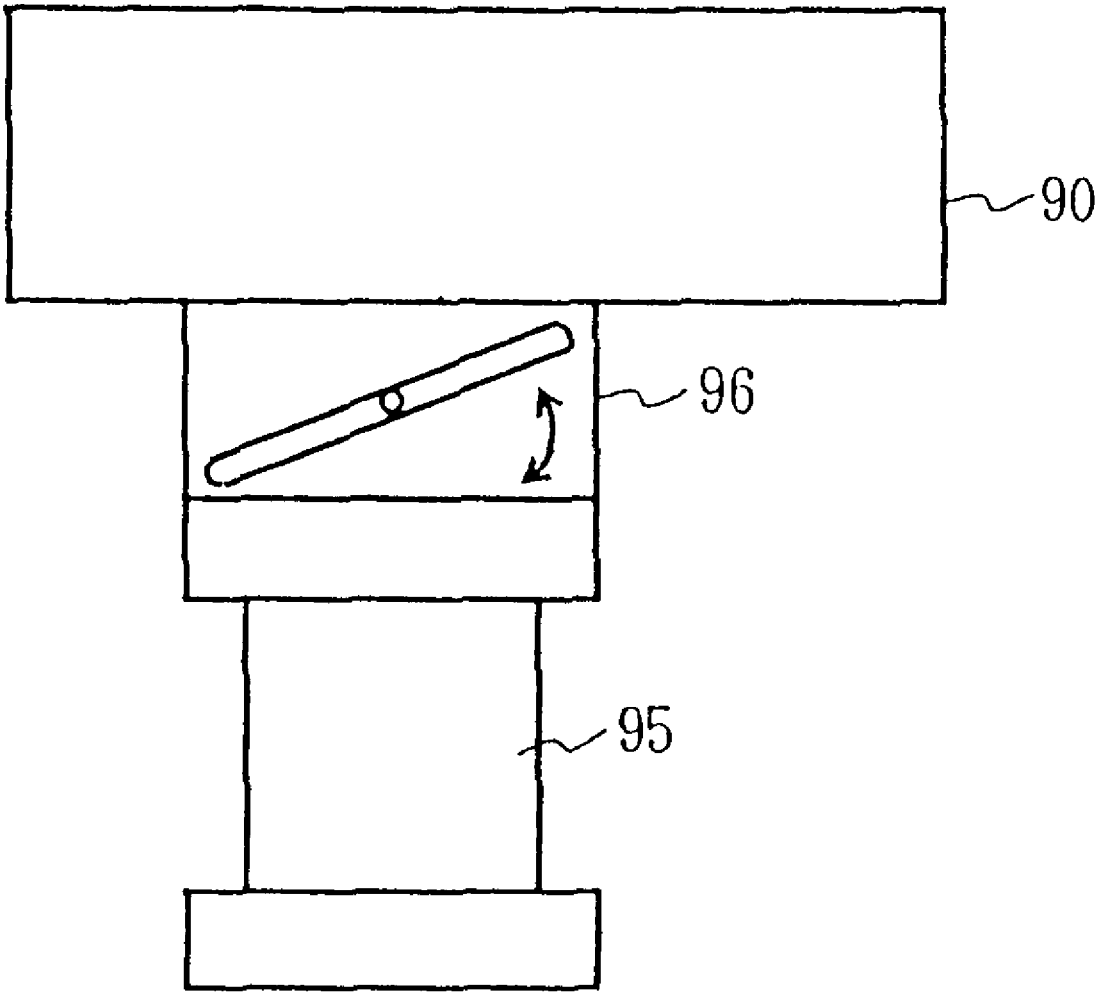
FIG. 16 is a sectional view showing an outline of the conventional vacuum apparatus.

FIGS. 14A to 14C are views showing another example of the vacuum pump according to the embodiment of the present invention having the conductance variable mechanism provided within the gas feeding portion. FIG. 14A is a plan view showing an outline of the conductance variable mechanism. FIG. 14B is a plan view showing a main part of the conductance variable mechanism. FIG. 14C is a view showing a cross-section of a main part of the vacuum pump according to the embodiment of the present invention, in which the conductance variable mechanism is employed.

A conductance variable mechanism 650 shown in FIGS. 14A to 14C comprises a ring-shaped member 651 provided with ventilation holes 651*a* at positions corresponding to the thread groove 81 of the thread groove spacer 80, the ringshaped member 651 having a gear portion 651*b* formed on the outer periphery thereof. The driving force from the stepping motor is transmitted via a small gear 653 and turn the ringshaped member 651 around, so that the ventilation holes 651*a* and the thread groove 81 overlaps more or less to increase or decrease the sectional area of the passage for gas.

A mechanism usable for the conductance variable mechanism in the case of disposing it at the outlet port 17, may be the same one that is disposed at the inlet port 16 which includes the conductance variable mechanisms in the embodiment described above and in the modification example thereof.

The mechanism for increasing or decreasing the passage area is not limited to the conductance variable mechanism, but may be, for instance, a mechanism comprising a plurality of gas passages having different sectional areas which are to be switched from one to another, or a mechanism in which the surrounding wall of the gas passage is made from an flexible material so that its sectional area is changed by the pressure applied from the outside of the gas passage.

In the embodiment described above, the gas feeding portion consists of the turbomolecular pump section T and the thread groove pump section S. However, the present invention is not limited thereto, and the gas feeding portion may consists, for instance, solely of the turbomolecular pump section T, or of the turbomolecular pump section T and a pump mechanism portion of a pump other than the tread groove pump section, such as a centrifugal flow type pump.

Although the rotor shaft 18 is received by a magnetic bearing, the bearing is not limited thereto, but may be a dynamic pressure bearing, a static pressure bearing, or other bearings.

The inner rotor type motor used in the vacuum pump 1 in the embodiment described above may be replaced by an outer rotor type motor.

As explained in the foregoing description, in a vacuum pump in accordance with the present invention, a gas sucking performance can be controlled.

In a vacuum pump in accordance with the present invention, a small space required for installing the apparatus with less manufacturing cost and less time-consuming assembly may be attained.

What is claimed is:

1. A vacuum pump comprising:

an inlet port for sucking gas;

a gas feeding portion for feeding gas sucked from the inlet port;

an outlet port for discharging the gas to an outside fed by the gas feeding portion;

a passage area increasing/decreasing mechanism for increasing/decreasing an area of a gas passage, provided at least one place from the inlet port to the outlet port; and a control means for controlling the passage area increasing/decreasing mechanism to increase/decrease the area of the gas passage.

2. A vacuum pump as claimed in claim 1, wherein the passage area increasing/decreasing mechanism is provided at a place from the inlet port to the gas feeding portion.

3. A vacuum pump as claimed in claim 1, wherein the passage area increasing/decreasing mechanism is provided at the gas feeding portion.

4. A vacuum pump as claimed in claim 3, wherein the gas feeding portion comprises: a turbomolecular pump section including stator blades secured in a multi-stage manner in a gas feeding direction and rotor blades rotating between the stator blades, for feeding gas by the rotation thereof; and a thread groove pump section adjoining to the turbomolecular pump section and including a rotational rotor side and a fixed stator side, at least one of the rotor side and the stator side being provided with thread grooves, for feeding gas by the rotation of the rotor side, wherein the passage area increasing/decreasing mechanism is provided to the thread groove pump section.

5. A vacuum pump as claimed in claim 3, wherein the gas feeding portion comprises a thread groove pump section including a rotational rotor side and a fixed stator side, at least one of the rotor side and the stator side being provided with thread grooves, for feeding gas by the rotation of the rotor side, wherein the passage area increasing/decreasing mechanism is provided to the thread groove pump section.

6. A vacuum pump as claimed in claim 1, wherein the passage area increasing/decreasing mechanism comprises a rotational plate rotating about an axis in a transverse direction of the gas passage, and the control means increases/decreases the area of the gas passage by changing an angle of the rotational plate relative to a plane including the axis in the transverse direction.

7. A vacuum pump as claimed in claim 6, wherein the gas passage formed in the passage area increasing/decreasing mechanism has a width of 20 mm or less.

8. A vacuum pump as claimed in claim 1, wherein the passage area increasing/decreasing mechanism includes an opening that forms the gas passage, the opening being provided with a plurality of plates arranged so as to overlap with each other, and the control means increases/decreases the area of the gas passage by displacing at least one of the plates relative to the other of the plates to thereby change an area of the overlapped portion of the openings of the respective plates.

9. A vacuum pump as claimed in claim 8, wherein the gas passage formed in the passage area increasing/decreasing mechanism has a width of 20 mm or less.

10. A vacuum apparatus comprising:

a vacuum pump as claimed in claim 1; and a container from which gas received therein is sucked and discharged by the vacuum pump.

11. A vacuum apparatus as claimed in claim 10, further comprising a pressure sensor for outputting a signal corresponding to a pressure within the container, wherein the control means determines an amount to be controlled responding to the output from the pressure sensor.

* * * * *